US008061974B2

(12) United States Patent
Gu et al.

(10) Patent No.: US 8,061,974 B2
(45) Date of Patent: Nov. 22, 2011

(54) COMPRESSOR WITH VARIABLE-GEOMETRY PORTED SHROUD

(75) Inventors: Ronren Gu, Torrance, CA (US); Eric S. Peery, Orern, UT (US)

(73) Assignee: Honeywell International Inc., Morristown, NJ (US)

( * ) Notice: Subject to any disclaimer, the term of this patent is extended or adjusted under 35 U.S.C. 154(b) by 645 days.

(21) Appl. No.: 12/208,940

(22) Filed: Sep. 11, 2008

(65) Prior Publication Data

US 2010/0061840 A1 Mar. 11, 2010

(51) Int. Cl.
*F04D 27/00* (2006.01)

(52) U.S. Cl. ..... 415/145; 415/58.4; 415/58.3

(58) Field of Classification Search ..... 415/145, 415/11

See application file for complete search history.

(56) References Cited

U.S. PATENT DOCUMENTS

| | | | | |
|---|---|---|---|---|
| 3,887,295 | A * | 6/1975 | Yu | 415/116 |
| 4,743,161 | A * | 5/1988 | Fisher et al. | 415/58.4 |
| 4,930,978 | A * | 6/1990 | Khanna et al. | 415/58.3 |
| 4,990,053 | A * | 2/1991 | Rohne | 415/58.4 |
| 5,246,335 | A * | 9/1993 | Mitsubori et al. | 415/58.3 |
| 5,333,990 | A * | 8/1994 | Foerster et al. | 415/58.4 |
| 5,403,149 | A * | 4/1995 | Arnet et al. | 415/58.6 |
| 5,863,178 | A * | 1/1999 | Scheinert et al. | 415/58.4 |
| 6,196,789 | B1 * | 3/2001 | McEwen et al. | 415/58.4 |
| 6,623,239 | B2 * | 9/2003 | Sahay et al. | 415/119 |
| 6,648,594 | B1 * | 11/2003 | Horner et al. | 415/145 |
| 6,679,057 | B2 * | 1/2004 | Arnold | 60/602 |
| 6,699,008 | B2 * | 3/2004 | Japikse | 415/58.4 |
| 7,025,557 | B2 * | 4/2006 | Japikse et al. | 415/1 |
| 7,162,872 | B2 * | 1/2007 | Schmid et al. | 60/602 |
| 7,775,759 | B2 * | 8/2010 | Sirakov et al. | 415/1 |
| 2002/0004004 | A1 * | 1/2002 | Fledersbacher et al. | 415/151 |
| 2005/0163606 | A1 * | 7/2005 | Svihla et al. | 415/58.4 |
| 2007/0224032 | A1 * | 9/2007 | Gu et al. | 415/58.4 |

* cited by examiner

*Primary Examiner* — Benjamin Sandvik
*Assistant Examiner* — Joseph Schoenholtz
(74) *Attorney, Agent, or Firm* — Alston & Bird LLP

(57) ABSTRACT

A compressor having a variable-geometry ported shroud includes a compressor housing defining an inlet duct, a shroud, and a bypass passage. A variable-geometry port extends through the shroud into the bypass passage, and includes an adjustable mechanism that is selectively configurable to adjust the meridional location of the port between at least first and second meridional locations. In one embodiment an opening extends through the shroud, and the adjustable mechanism includes a bypass control device that is disposed within the opening and is axially movable therein. The bypass control device has an axial length less than that of the opening such that there is always a portion of the opening that remains unblocked by the bypass control device and forms a port through the shroud. The bypass control device is axially movable between at least first and second positions to place the port at the first and second meridional locations.

19 Claims, 15 Drawing Sheets

COMPRESSOR WITH VARIABLE-GEOMETRY PORTED SHROUD

BACKGROUND OF THE INVENTION

The present disclosure generally relates to compressors, such as those used in turbochargers for internal combustion engines. The disclosure more particularly relates to compressors having a ported shroud and a bypass passage connected to the port in the shroud and to the compressor inlet duct, whereby fluid can flow in either direction through the bypass passage, depending on operating condition, to help alleviate surge and increase flow at choke and thereby extend the usable flow range of the compressor.

In many automotive turbocharger applications, it is a challenging task to supply a compressor having an adequately wide flow range from surge on the low end to choke on the high end. Many workers in this field have developed a host of designs and methods for extending the usable flow range. Probably the most widely used and effective design for compressor flow range enhancement is the ported shroud. In a compressor having a ported shroud in its simplest form, the shroud has one or more ports that extend through it into a bypass passage defined in the compressor housing, and the bypass passage has an end that is fluidly coupled to the inlet duct of the compressor. At low-flow operating conditions near the surge line, part of the fluid that has already been at least partially compressed by the compressor can pass through the port(s) in the shroud and be recirculated back to the compressor inlet via the bypass passage. This has been found to help alleviate surge and therefore allow the compressor to operate down to lower flow rates before surge occurs at a given pressure ratio. At high-flow operating conditions near choke, some of the fluid entering the inlet duct can flow from the inlet duct into the bypass passage and out through the port(s). This has been found to enable a higher flow rate to be achieved.

While this simple ported shroud design is an improvement over non-ported designs, it has been recognized that the optimum port configuration for near-surge conditions is not necessarily (and indeed not usually) optimum for near-choke conditions. Accordingly, some workers in the field have developed variable-geometry mechanisms that enable the port configuration to be varied depending on operating condition.

At least from the standpoint of flow range enhancement, some of these variable-geometry ported shroud designs are improvements relative to fixed-geometry ported shroud designs. However, further improvement is desired.

BRIEF SUMMARY OF THE DISCLOSURE

The present applicant has discovered that the meridional location of the port relative to the compressor blades can have a significant effect on the aerodynamics and the resulting impact on compressor surge line and/or choke line location on the compressor map. In particular, it has been found that the meridional location that would be desirable for improving the surge situation is not the same meridional location that would be desirable for improving the choke situation. Existing variable-geometry ported shroud designs, however, do not provide a means for effectively varying the meridional location of the port depending on operating condition.

In accordance with one aspect of the present disclosure, there is described a compressor having a variable-geometry ported shroud, comprising:

a compressor housing defining an inlet duct, a shroud, and a bypass passage;

a compressor wheel rotatably mounted in the compressor housing; and a variable-geometry port extending through the shroud into the bypass passage, the variable-geometry port comprising an adjustable mechanism that is selectively configurable to adjust the meridional location of the port between at least first and second meridional locations.

For example, in one embodiment the variable-geometry port comprises an opening extending through the shroud, and the adjustable mechanism comprises a bypass control device disposed within the opening and axially movable therein. The bypass control device has an axial length less than that of the opening such that in all possible axial positions of the bypass control device there is a portion of the opening that remains unblocked by the bypass control device and forms a port through the shroud. The bypass control device is axially movable within the opening between at least first and second positions that respectively place the port at the first and second meridional locations.

The bypass control device in one particular embodiment comprises separately formed first and second bypass control members that are axially movable together as a unit as well as independently of each other in order to adjust port location. The first and second bypass control members can be abutted against each other and positioned at one axial end of the opening in the shroud to position the port at the first meridional location, can be abutted against each other and positioned at an opposite axial end of the opening to position the port at the second meridional location, and can be axially spaced apart from each other to position the port at an intermediate third location between the first and second bypass control members.

Alternatively, the bypass control device can comprise a single bypass control member providing the ability to establish ports at the first and second meridional locations only.

In some embodiments, the opening through the shroud is annular and the bypass control device is annular. In those embodiments employing first and second bypass control members, they can respectively comprise first and second ring portions that at least partially reside within the annular opening in the shroud.

The first and second bypass control members can be connected to an actuator assembly operable to effect axial movement of the first and second bypass control members independently of each other. For example, the first and second bypass control members can further comprise first and second connecting portions respectively joined to the first and second ring portions and residing at least partially within the bypass passage, and the actuator assembly can include first and second linkages respectively connected to the first and second connecting portions.

The first connecting portions can project radially outwardly from the first ring portion and extend radially beyond the second ring portion, and the second connecting portions likewise can project radially outwardly from the second ring portion and extend radially beyond the first ring portion, the first connecting portions and associated first linkages being circumferentially staggered relative to the second connecting portions and associated second linkages.

In one embodiment, there are two first connecting portions located on diametrically opposite sides of the first ring portion, and two second connecting portions located on diametrically opposite sides of the second ring portion. The first connecting portions are staggered (e.g., by 90°) relative to the second connecting portions. The first linkages can comprise a pair of first elongate members extending axially in the bypass passage and having ends respectively connected to the first connecting portions, and the second linkages can comprise a pair of second elongate members extending axially in the bypass passage and having ends respectively connected to the second connecting portions. Opposite ends of the first elongate members can be connected to a first mechanism operable to effect axial movement of the first elongate members to adjustably position the first bypass control member relative to the opening in the shroud, and opposite ends of the second elongate members can be connected to a second mechanism operable to effect axial movement of the second elongate members to adjustably position the second bypass control member relative to the opening in the shroud.

The variable-geometry port can further include a guide assembly defining first guide passages that receive the first elongate members and guide the axial movement thereof, and second guide passages that receive the second elongate members and guide the axial movement thereof.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
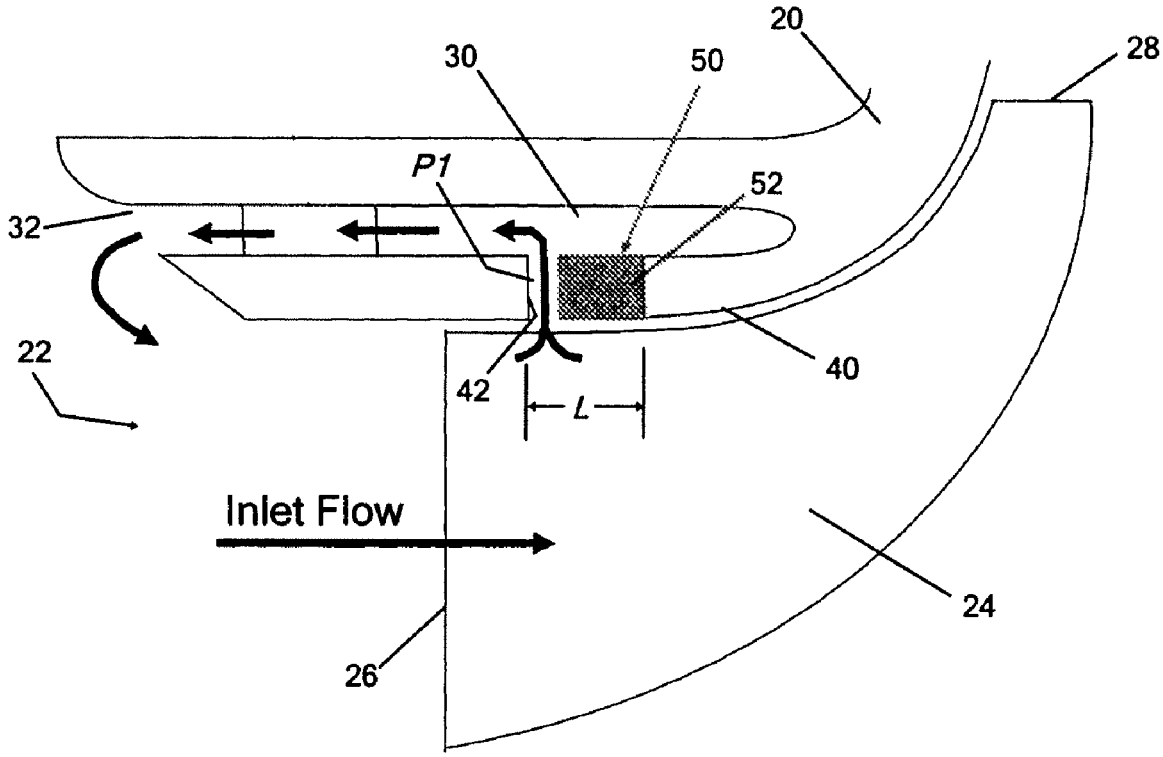
FIG. 1 is a schematic depiction of a variable-geometry ported shroud in accordance with one embodiment of the invention, wherein the bypass control device employs a single bypass control member axially slidable within an opening through the shroud, and showing the bypass control member in a first position so as to create a first port at a first meridional location.
Figure 2:
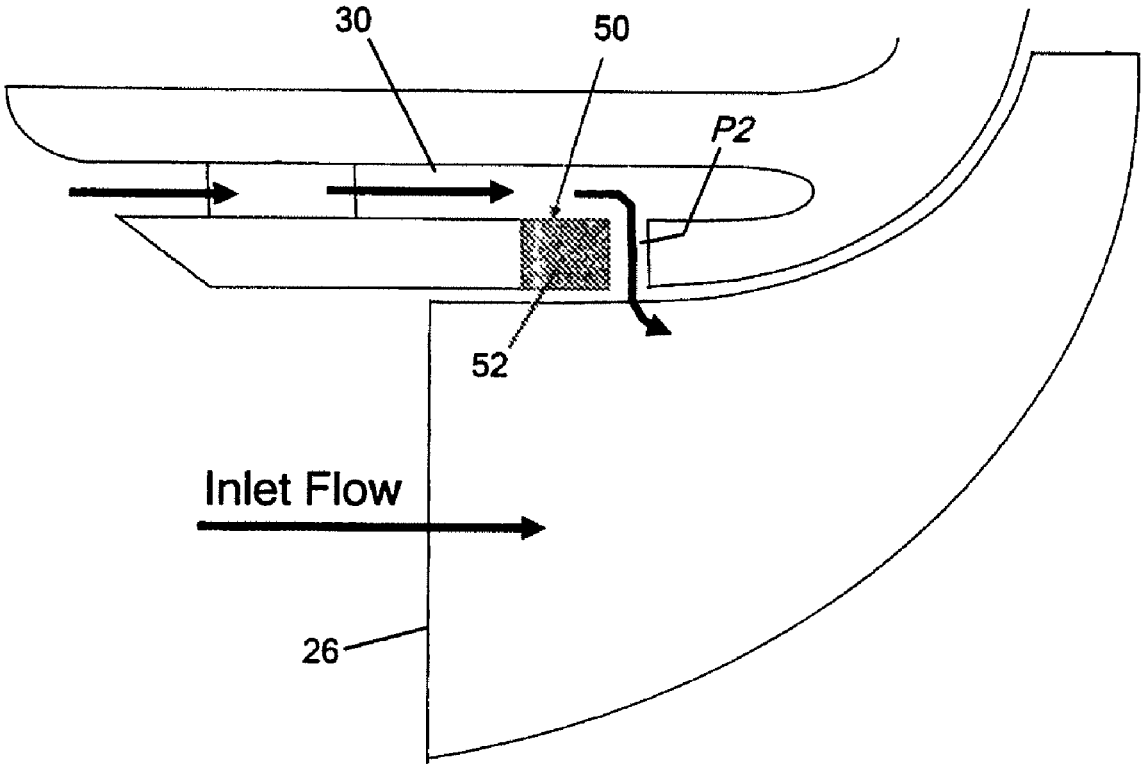
FIG. 2 is a schematic depiction similar to FIG. 1, with the bypass control member in a second position in which the first port is eliminated and a second port is created at a second meridional location.

FIGS. 1 and 2 schematically depict a variable-geometry ported shroud for a compressor, in accordance with a first embodiment of the present invention. The compressor includes a compressor housing 20 defining an inlet 22 that leads fluid in an axial direction into a compressor wheel having a plurality of blades 24 each of which has a leading edge 26 and a trailing edge 28. The compressor housing 20 defines a bypass passage 30 that extends generally parallel to the axial direction and connects at one end 32 to the inlet 22. The compressor housing also defines a shroud 40 that surrounds the compressor wheel and is spaced by a small radial clearance from the tips of the blades 24. The shroud 40 and the hub of the compressor wheel together bound and define a flow path through which fluid passes, the blades compressing the fluid and discharging it radially outwardly into a volute (not shown) of the compressor housing. The shroud 40 defines an opening 42 extending therethrough into the bypass passage 30. The opening 42 is annular in configuration and has a length L in the meridional direction.

The variable-geometry aspect of the ported shroud is accomplished by the inclusion of an adjustable mechanism or bypass control device 50 that acts in conjunction with the opening 42 to permit selective creation of a port through the shroud at either of two different meridional locations. In the illustrated embodiment, the bypass control device 50 comprises a single ring 52 that resides at least partially within the annular opening 42. The ring 52 has an axial length less than the axial length L of the opening 42, and is axially slidable within the opening. In particular, the ring 52 is slidable between a first position as in FIG. 1 in which the ring is abutting one axial end wall of the opening 42, and a second position as in FIG. 2 in which it is abutting the opposite axial end wall of the opening. As a result, when the ring is in the first position (FIG. 1), a first port P1 is created by the portion of the axial length of the opening 42 that is not blocked by the ring. Moving the ring to the second position (FIG. 2) results in the elimination of the first port and the creation of a second port P2 at a different meridional location.

Thus, the variable-geometry ported shroud allows selective placement of the port at either of two different meridional locations. For instance, at low-flow (near-surge) conditions, it may be preferable to locate the ring 52 in the first position so as to form the first port P1 at a location relatively closer to the blade leading edges 26, as shown in FIG. 1. Some portion of the fluid can then flow radially outwardly from the main flow path, through the port P1 into the bypass passage 30, and then out the end 32 of the bypass passage back into the compressor inlet 22. This flow recirculation can move the surge line on the compressor map to a lower flow rate for a given pressure ratio.

On the other hand, at high-flow (near-choke) conditions, it may be preferable to locate the ring 52 in the second position so as to form the second port P2 at a location relatively farther from the blade leading edges, as shown in FIG. 2. This can allow additional flow rate through the compressor by allowing fluid to enter the bypass passage 30 (thereby bypassing the inlet 22) and flow inwardly through the second port P2 into the main flow path. This can have the effect of moving the choke line on the compressor map to a higher flow rate for a given pressure ratio.

The movement of the ring 52 between the two positions can be effected by any suitable actuator mechanism, under the control of a controller that can adjust the ring position as a function of one or more parameters monitored by suitable sensors. For example, the controller can receive a signal indicative of engine speed and can control the ring position as a function of that speed. This is merely one simplified example. Any suitable control scheme can be used for determining the optimal position of the ring at any given operating condition.

Figure 3:
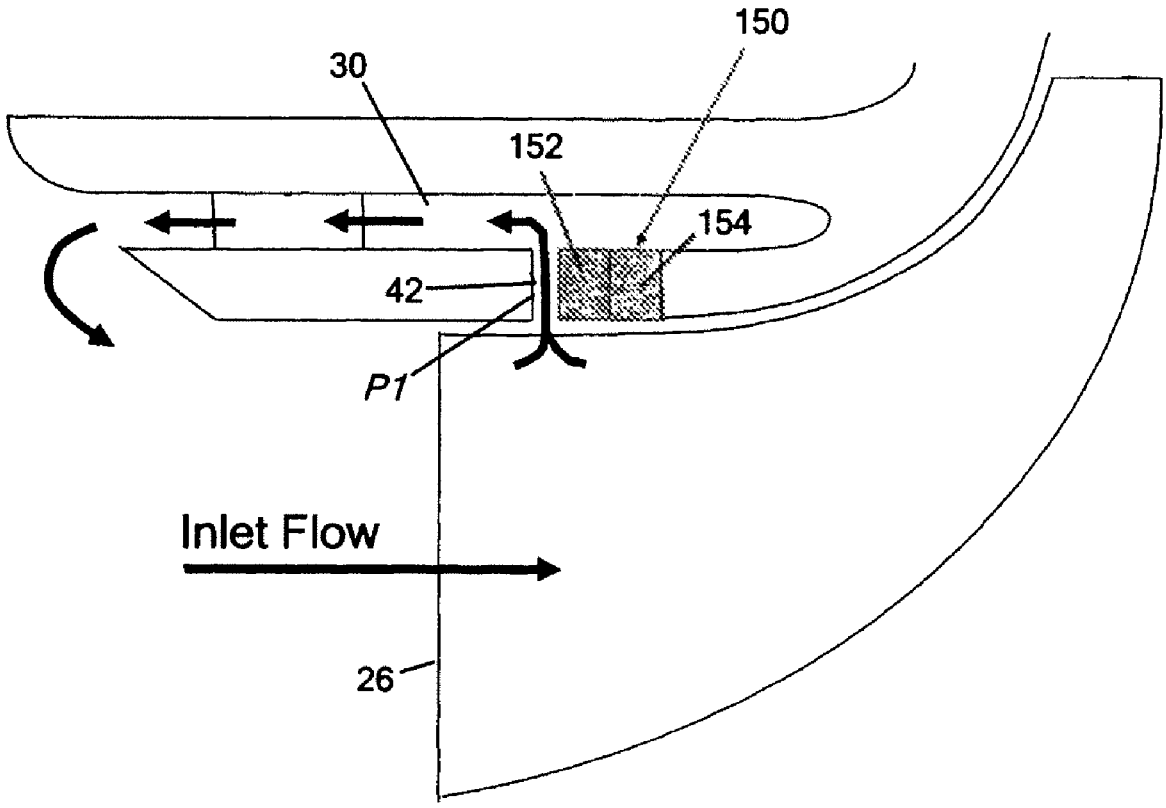
FIG. 3 is a schematic depiction showing another embodiment of a variable-geometry ported shroud, wherein the bypass control device employs a pair of bypass control members that are axially slidable independently of each other, and showing the bypass control members in a first configuration so as to create a first port at a first meridional location.
Figure 4:
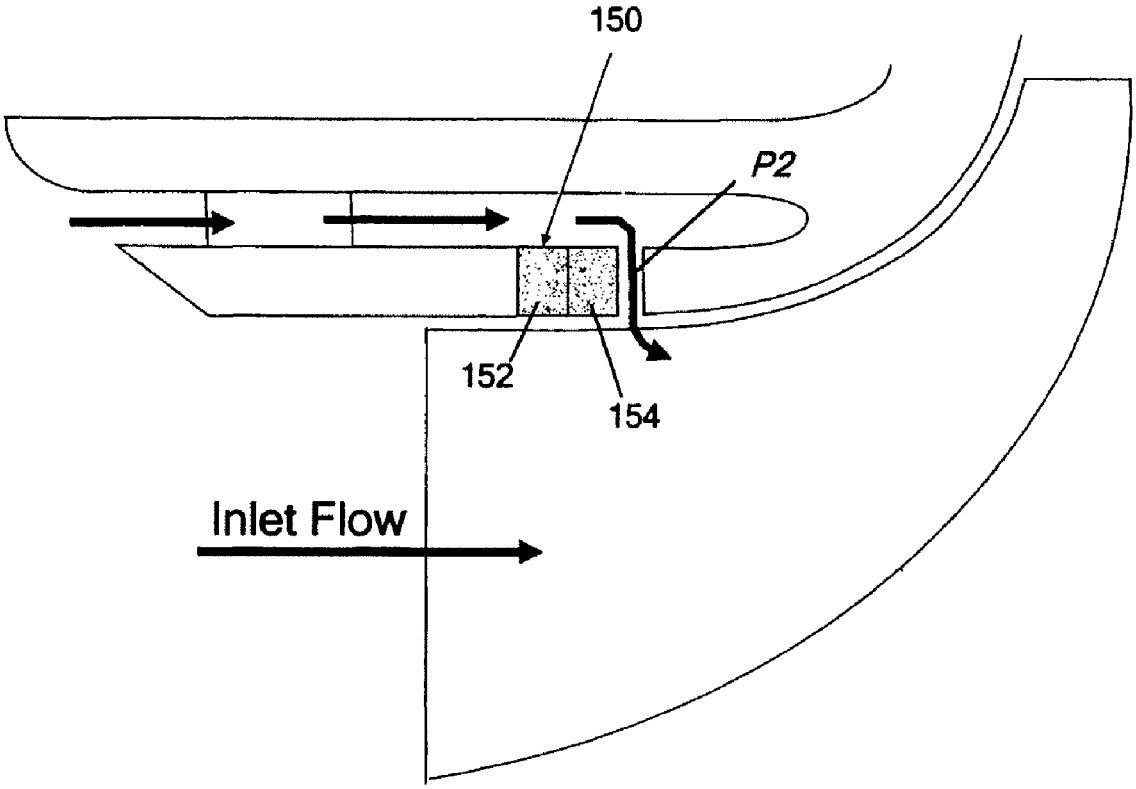
FIG. 4 is a schematic depiction similar to FIG. 3, with the bypass control members in a second configuration in which the first port is eliminated and a second port is created at a second meridional location.
Figure 5:
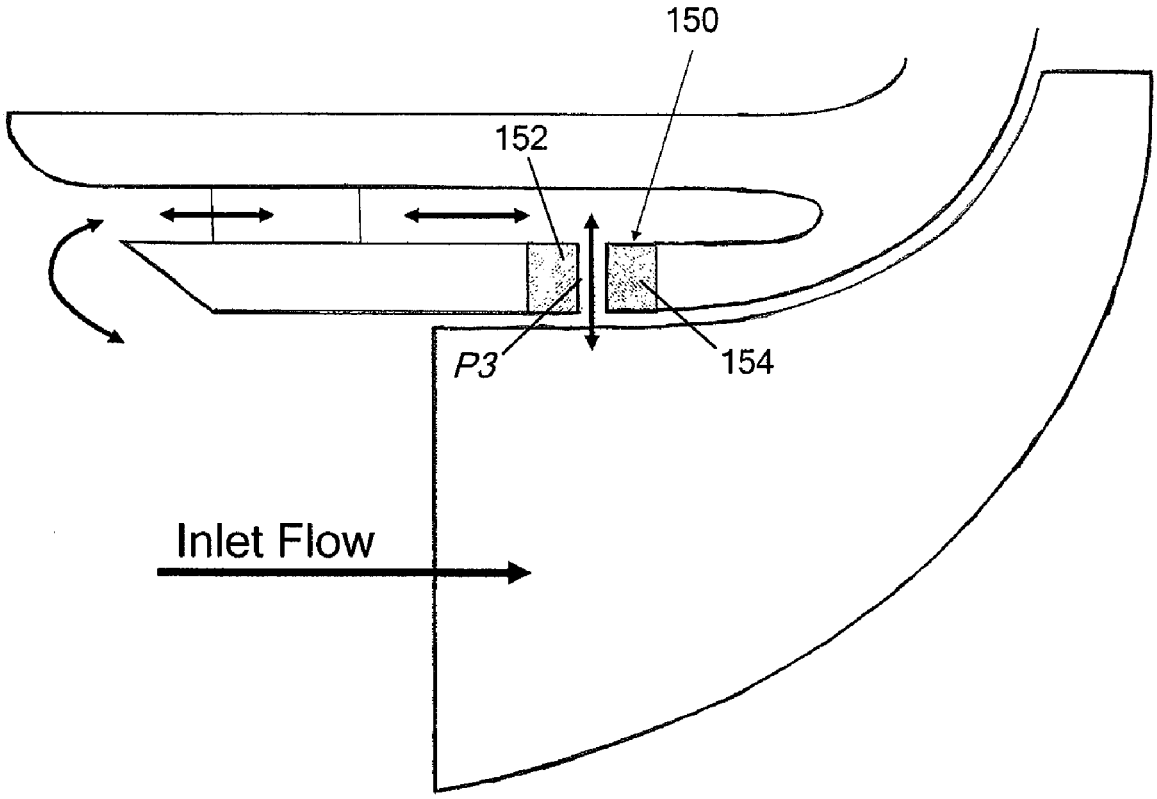
FIG. 5 is a schematic depiction similar to FIG. 3, with the bypass control members in a third configuration so as to create a third port at a third meridional location intermediate the first and second meridional locations.
Figure 6:
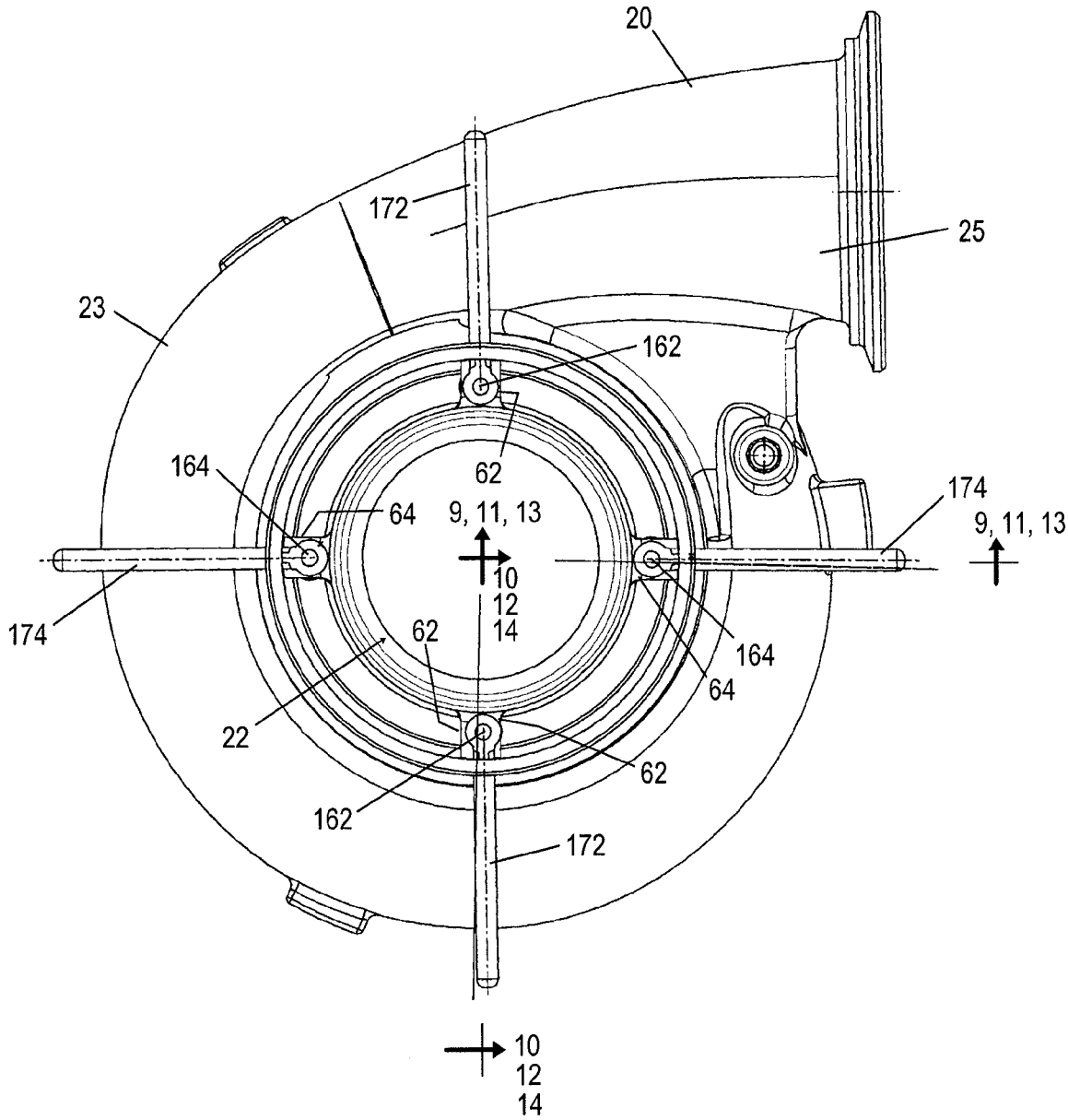
FIG. 6 is an end view of a compressor housing assembly in accordance with one embodiment of the invention, looking axially into the compressor inlet along the main flow direction.

A second embodiment of the invention is illustrated in FIGS. 3 through 5. The variable-geometry ported shroud of this embodiment is generally similar to that of the first embodiment, except that it employs a bypass control device 150 in the form of two separate rings 152 and 154. The two rings combined (when abutted against each other) have an axial length less than that of the opening 42 in the shroud, as in the prior embodiment. Thus, the two rings can be moved as a unit (keeping them in abutting contact with each other) between the first and second positions, similar to the prior embodiment. FIG. 3 shows the rings in a first position, creating a first port P1, similar to FIG. 1. FIG. 4 shows the rings in a second position, creating a second port P2, similar to FIG. 2. However, the rings are independently movable and thus can be moved apart from each other to create a third port P3 between the rings, at an intermediate meridional location between those of the first and second ports. This is illustrated in FIG. 5. The third port P3 may be useful when the compressor is operating in the middle of its map (neither near surge nor near choke). At such operating conditions, the third port can serve as a "bridge" wherein little or no fluid passes through the port (although, as depicted in FIG. 5, a small amount of fluid can flow in either direction through the port), and hence there is little or no efficiency penalty associated with the presence of the ported shroud when the third port P3 exists.

While the rings 152 and 154 are shown as having the same thicknesses or axial lengths, this is not necessary, and the axial lengths can be different from each other if desired or needed in a particular case. In general, the axial length L of the shroud opening 42 and the axial lengths of the rings 152, 154 can be selected in order to form different port locations and sizes for specific engine requirements in each case.

As noted, an actuator assembly is needed for effecting the axial movements of the bypass control device 50, 150. One exemplary actuator assembly is now described for the two-ring embodiment such as that of FIGS. 3-5. However, it will be understood that this actuator assembly is merely illustrative, and the invention is not limited to any particular actuation device. With reference to FIGS. 6-15, various views are presented of a compressor housing assembly having a variable-geometry ported shroud, in accordance with one embodiment of the invention. The assembly includes a compressor housing 20 that defines an inlet 22 through which fluid enters along the axial direction, and defines a volute 23 that receives the fluid after it has been compressed by the compressor wheel (not shown). Fluid exits the volute through a discharge conduit 25.

The compressor housing includes a shroud 40 that defines the part of the compressor main flow path proximate the tips of the compressor blades, as previously discussed. A bypass passage 30 is defined in the compressor housing. In the illustrated embodiment, the bypass passage 30 and shroud 40 are defined in part by the main compressor housing structure and in part by a separate insert 60 of generally annular configuration that is affixed to the main housing structure by threaded fasteners or other suitable means. An opening 42 through the shroud into the bypass passage 30 is defined as a gap between the insert 60 and the main housing structure. The bypass passage 30 is defined between the insert 60 and a wall of the compressor housing.

Figure 9:
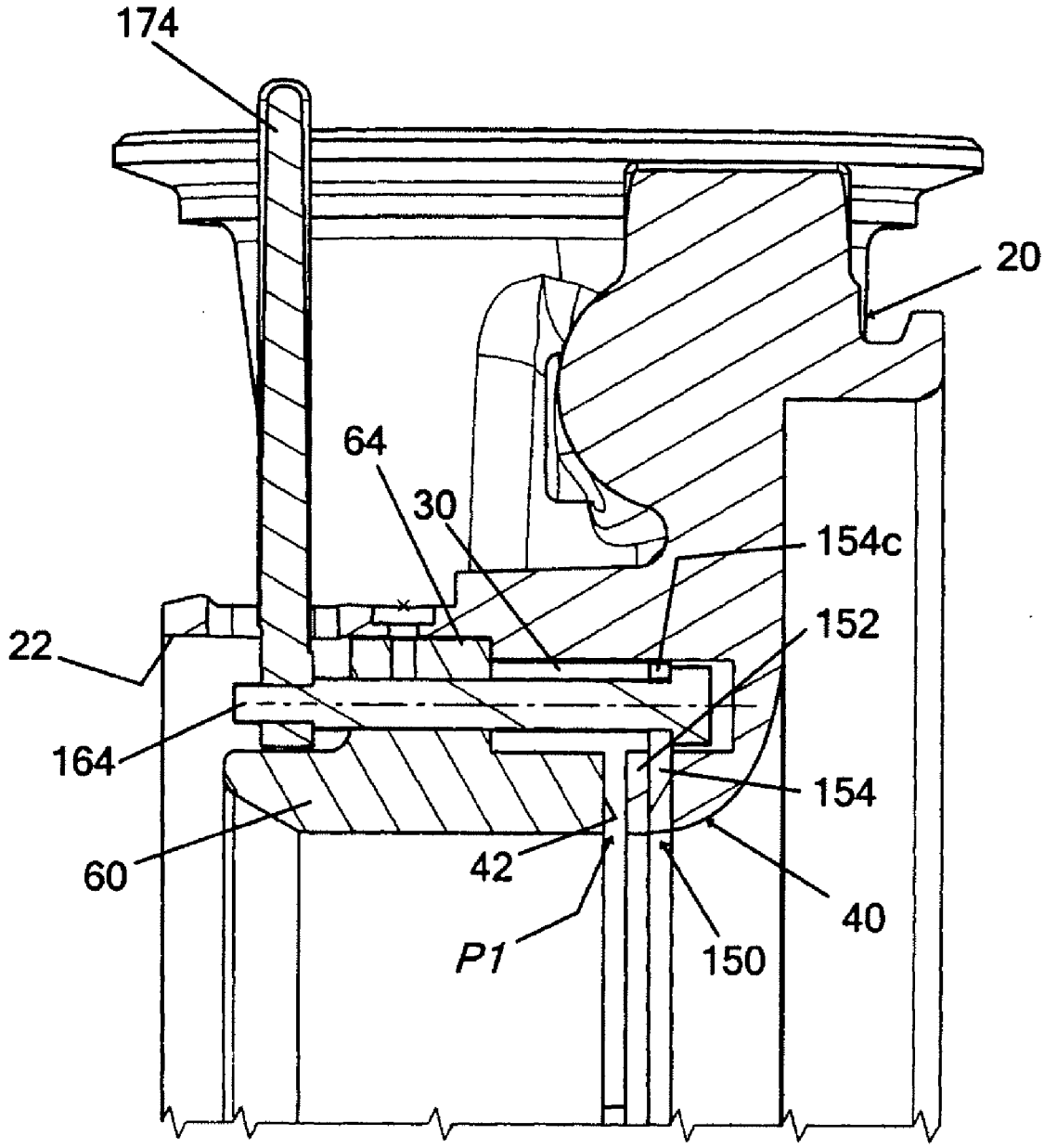
FIG. 9 is a cross-sectional view along line 9-9 in FIG. 6, showing the bypass control device in a first configuration.

With particular reference to FIGS. 9-14, the assembly includes a bypass control device 150 comprising a pair of bypass control members or rings 152, 154 that reside within the opening 42. The rings 152, 154 are configured such that their radially inner circular surfaces are substantially flush with the radially inner surface of the shroud 40 when the rings are arranged coaxially with respect to the shroud. Each ring includes a pair of connecting portions that project radially outwardly from the radially outer circular surface of the ring. In FIG. 9, the ring 154 is shown to have a connecting portion 154c that extends radially outwardly beyond the outer edges of the rings 152, 154 into the bypass passage 30 in the compressor housing. The ring 154 also has a second connecting portion (not shown) circumferentially spaced from (e.g., diametrically opposite from) the illustrated connecting portion **154*c* that likewise extends into the bypass passage. Each of the connecting portions 154*c* is connected to one end of an elongate member or linkage 164 that extends axially within the bypass passage 30. The linkages 164 pass through guide passages in a pair of webs acting as guides 64 that are integrally formed as part of the insert 60 and extend radially outwardly into the bypass passage. The webs/guides 64 serve to connect the insert 60 to the main compressor housing structure and space it from such structure so as to define the bypass passage 30. The ends of the linkages 164 opposite from the ends connected to the connecting portions 154*c* are connected to respective control shafts 174** that extend radially outwardly and are arranged to be coupled with a suitable actuation device.

Figure 10:
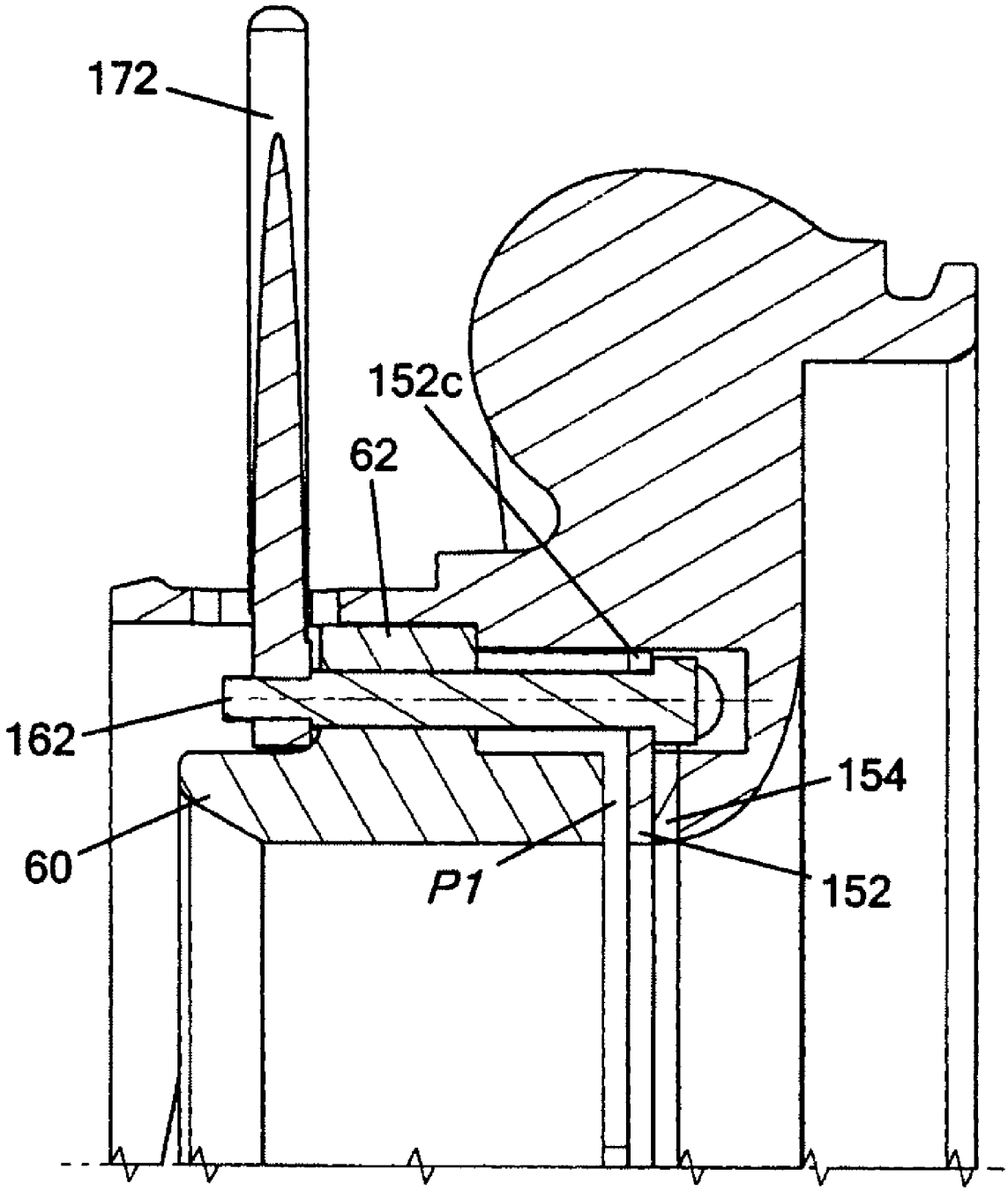
FIG. 10 is a cross-sectional view along line 10-10 in FIG. 6, showing the bypass control device in the first configuration.

In FIG. 10, the ring 152 is shown to have a connecting portion **152*c* that extends radially outwardly beyond the outer edges of the rings 152, 154 into the bypass passage 30 in the compressor housing. The ring 152 also has a second connecting portion (not shown) circumferentially spaced from (e.g., diametrically opposite from) the illustrated connecting portion 152*c* that likewise extends into the bypass passage. Each of the connecting portions 152*c* is connected to one end of an elongate member or linkage 162 that extends axially within the bypass passage 30. The linkages 162 pass through guide passages in another pair of webs acting as guides 62 that are integrally formed with the insert 60. The ends of the linkages 162 opposite from the ends connected to the connecting portions 152*c* are connected to respective control shafts 172** that extend radially outwardly and are arranged to be coupled with a suitable actuation device.

The linkages 162 and respective guides 62, connecting portions **152*c*, and control shafts 172 are circumferentially staggered relative to the linkages 164 and respective guides 64, connecting portions 154*c*, and control shafts 174. In the illustrated embodiment, the stagger is 90°, but this is not essential, and other amounts of stagger can be used. Additionally, the pair of connecting portions 152***c* and their associated linkages 162 and control shafts 172 are shown as being diametrically opposite each other, and the same is true for the pair of connecting portions 154*c* and associated linkages 164 and control shafts 174, but this is not essential, and they could instead be less than 180° apart. If desired, the guides or webs 62, 64 can be spaced apart unevenly about the circumference of the bypass passage, which can help reduce aerodynamic noise associated with the presence of the webs.

The control shafts 172 for the first ring 152 are axially movable so as to axially move the linkages 162 and thereby move the first ring 152 axially within the opening 42 in the shroud 40. Likewise, the control shafts 174 for the second ring 154 are axially movable for moving the linkages 164 such that the second ring 154 is moved within the opening. FIGS. 9 and 10 illustrate a first configuration of the bypass control device in which the rings 152, 154 are both positioned in their rearmost positions so as to create a first port P1 at an axially forward location in the shroud.

Figure 11:
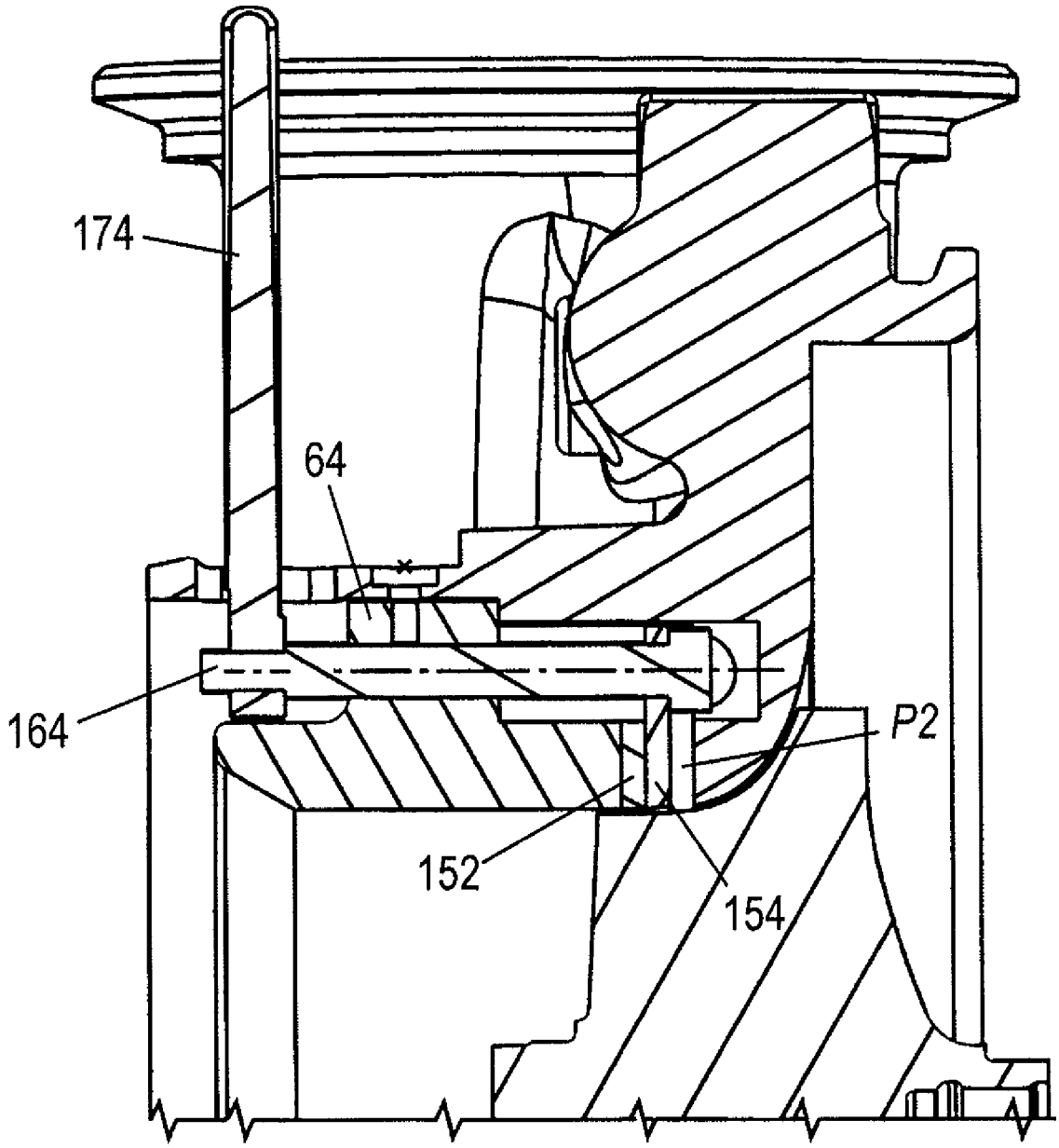
FIG. 11 is a cross-sectional view along line 11-11 in FIG. 6, showing the bypass control device in a second configuration.
Figure 12:
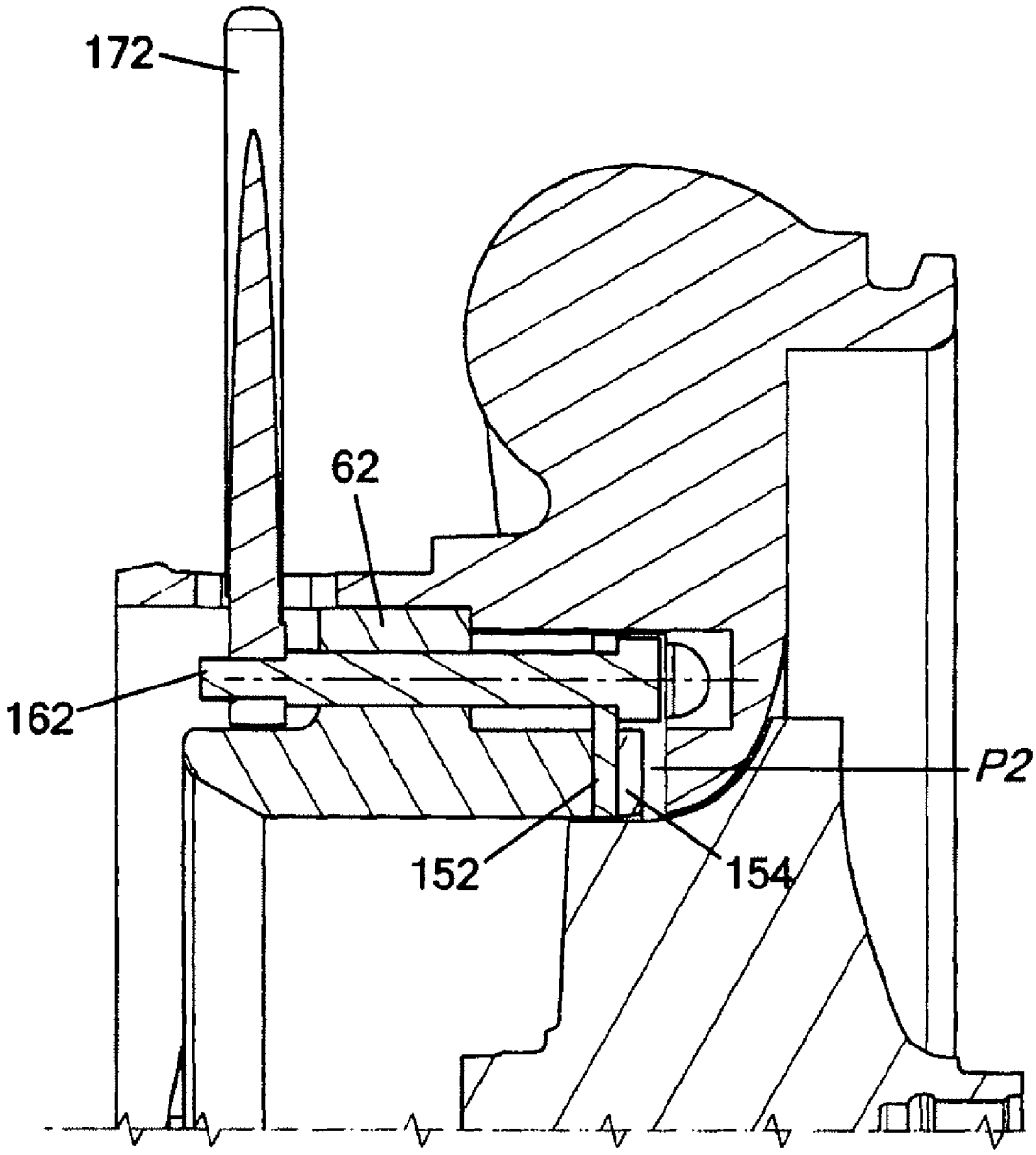
FIG. 12 is a cross-sectional view along line 12-12 in FIG. 6, showing the bypass control device in the second configuration.

To move the port location to an axially rearward location, the rings 152, 154 are both moved forward by suitable actuator devices acting on the control shafts 172, 174 so as to configure the ported shroud with a port P2 as shown in FIGS. 11 and 12.

Figure 13:
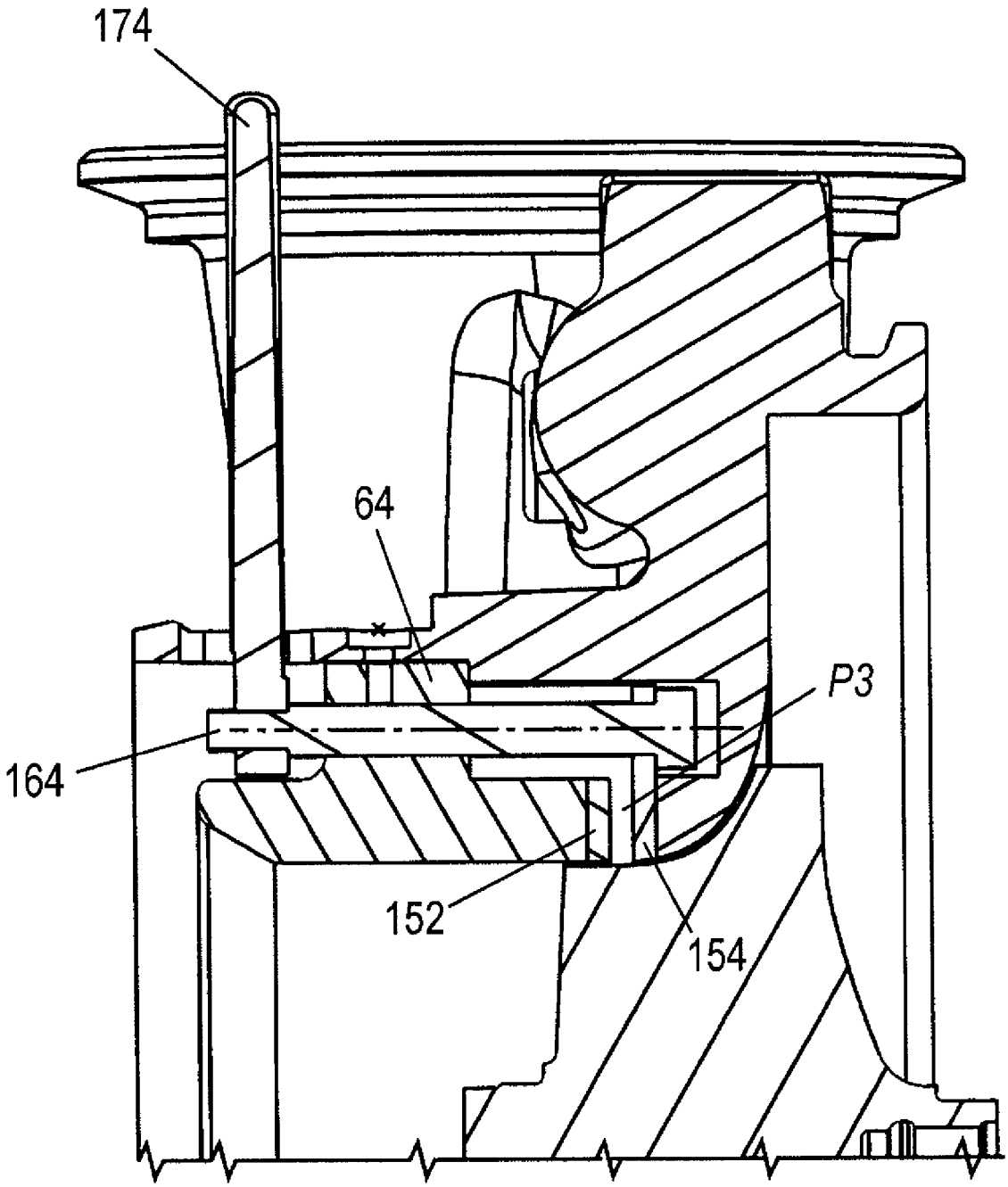
FIG. 13 is a cross-sectional view along line 13-13 in FIG. 6, showing the bypass control device in a third configuration.
Figure 14:
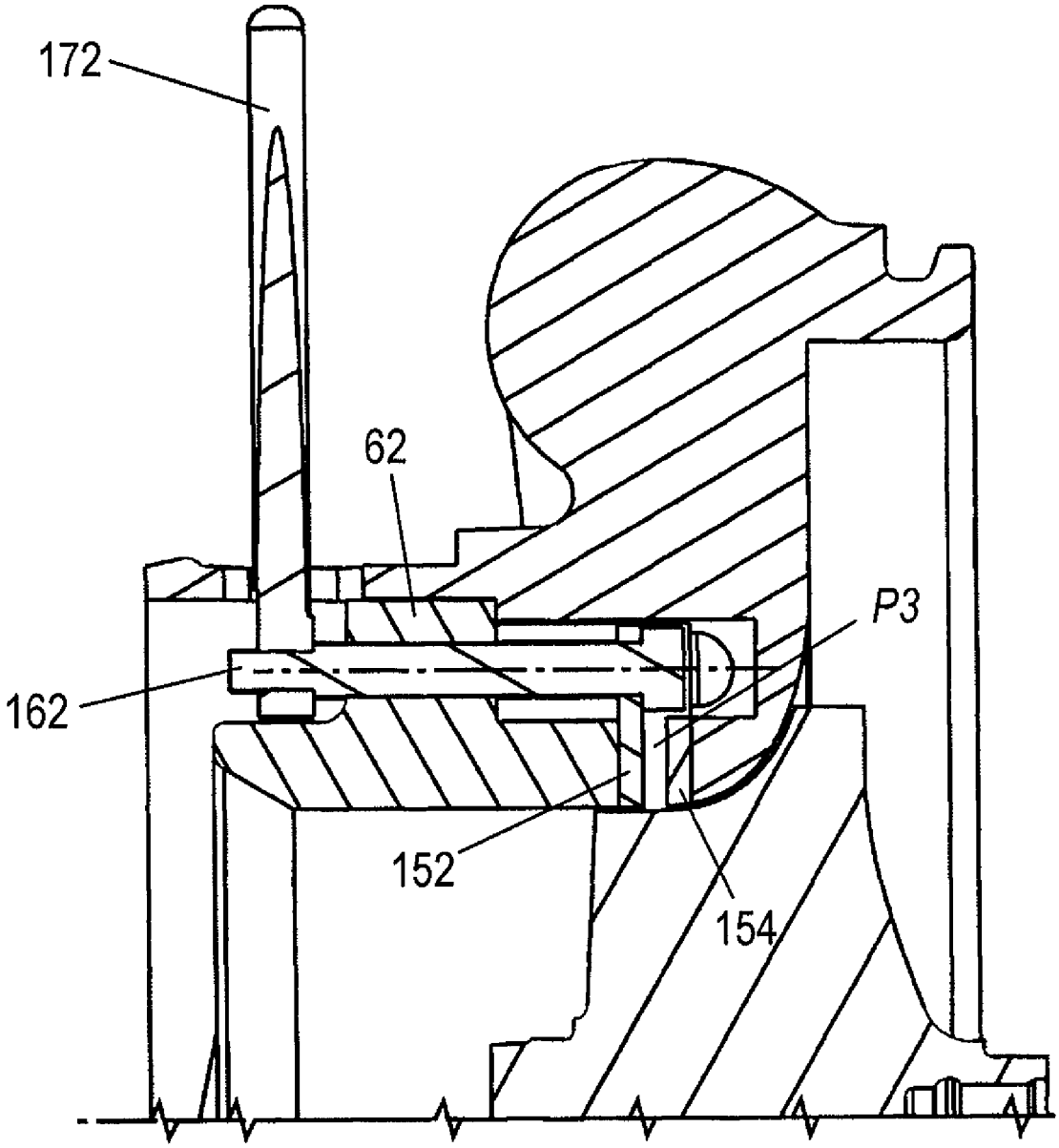
FIG. 14 is a cross-sectional view along line 14-14 in FIG. 6, showing the bypass control device in the third configuration.
Figure 15:
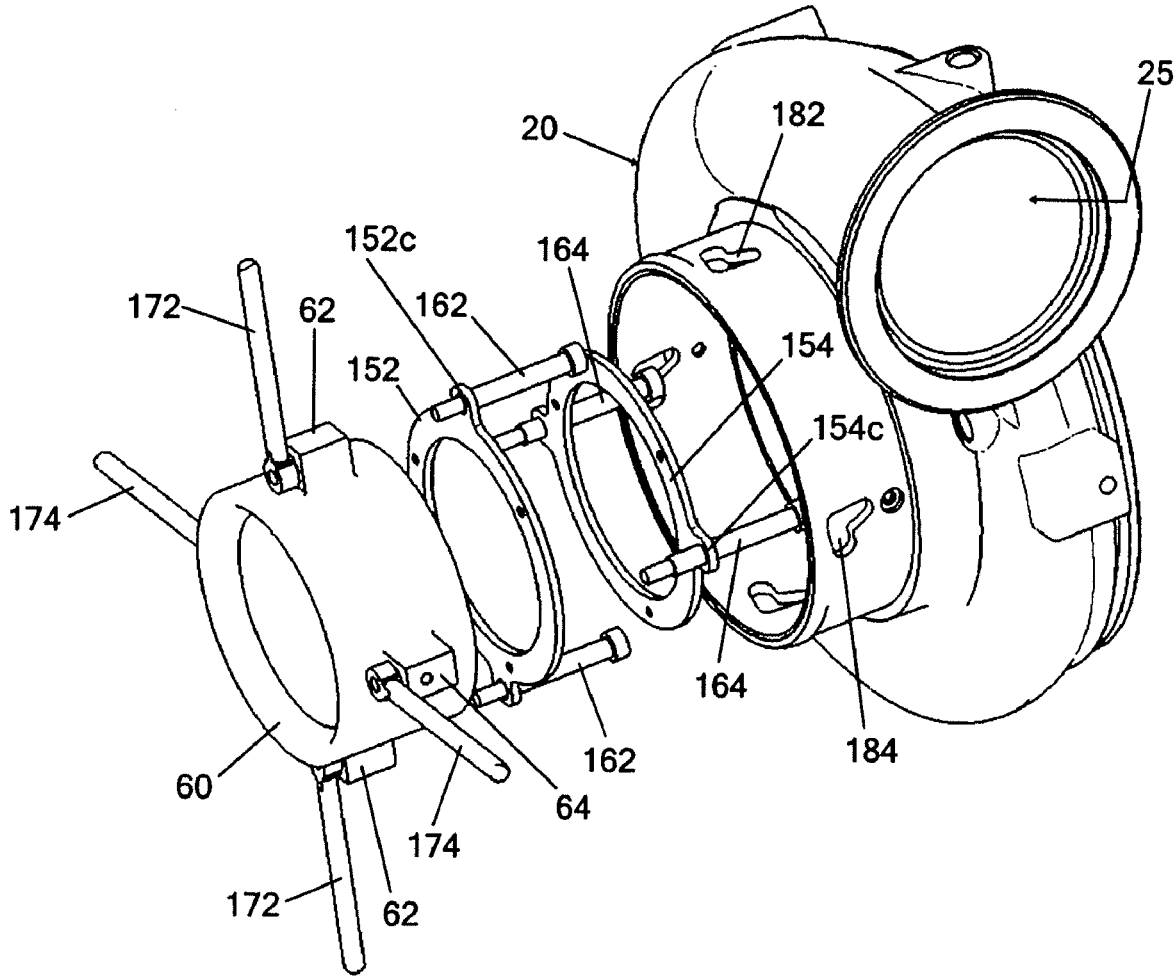
FIG. 15 is an exploded view of the compressor housing assembly of FIG. 8.

To move the port location to an intermediate location, the ring 152 is positioned at its forwardmost position by a suitable actuator device acting on the control shafts 172, and the ring 154 is positioned at its rearmost position by a suitable actuator device acting on the control shafts 174, thereby configuring the ported shroud with a port P3 as shown in FIGS. 13 and 14.

Figure 7:
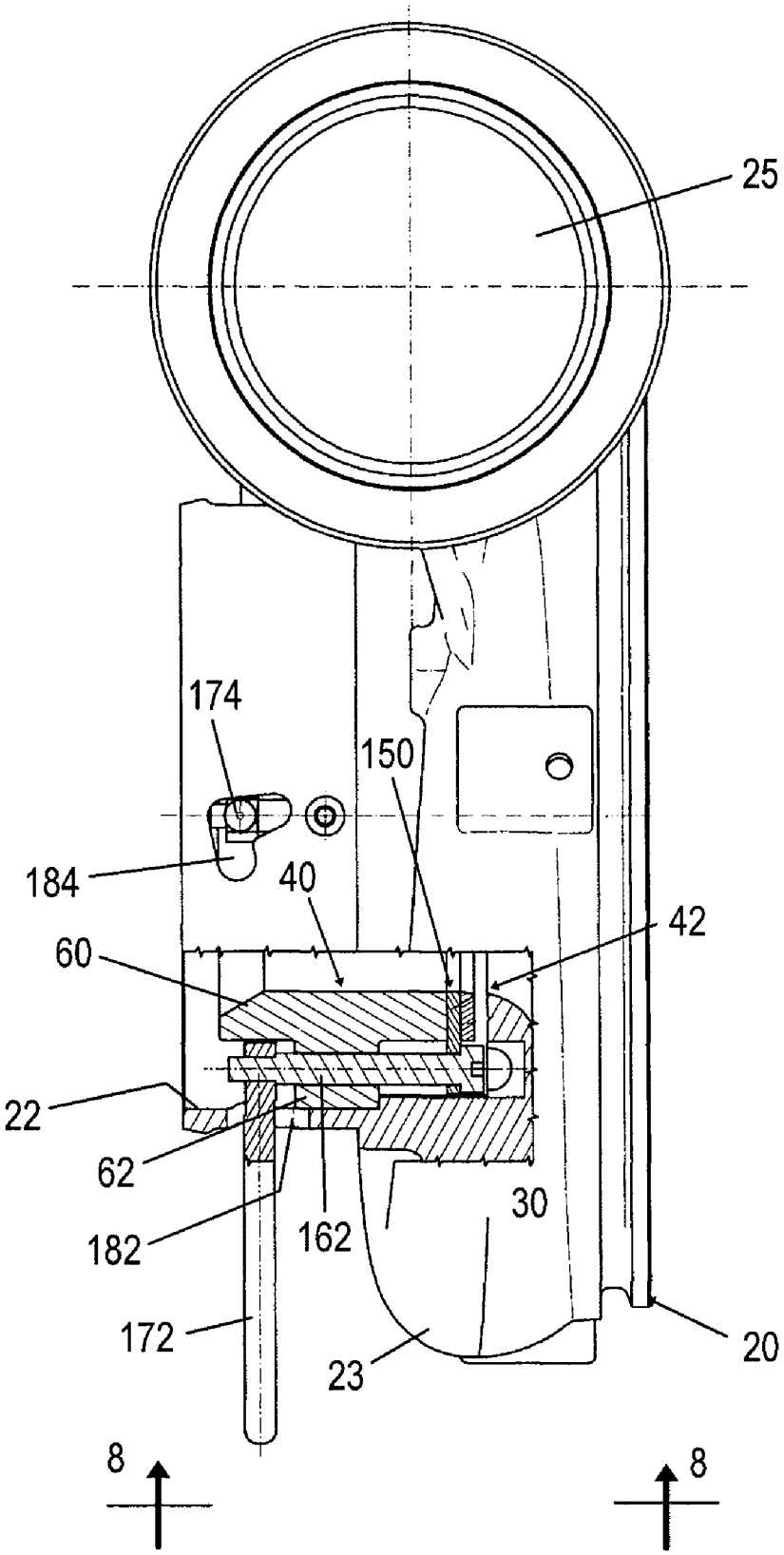
FIG. 7 is a view of the compressor housing assembly looking in the direction indicated by line 7-7 in FIG. 6, showing the assembly partly in section.
Figure 8:
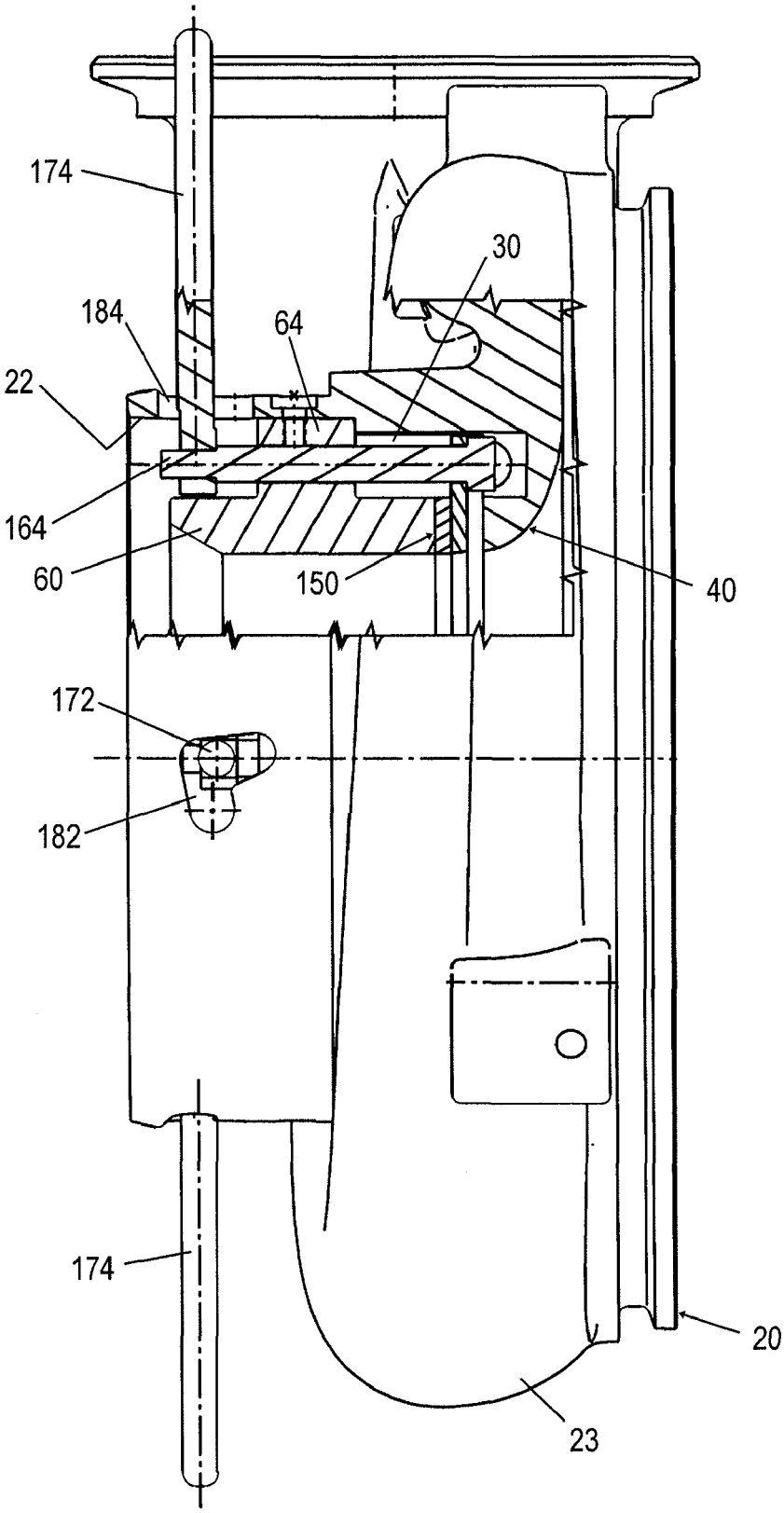
FIG. 8 is a view of the compressor housing assembly looking in the direction indicated by line 8-8 in FIG. 7, showing the assembly partly in section.

As shown in FIGS. 7 and 8, the control shafts 172 pass generally radially outwardly through generally L-shaped holes 182 in the compressor housing. Similarly, the control shafts 174 pass through generally L-shaped holes 184 in the compressor housing. The holes 182, 184 are L-shaped to enable the control shafts 172, 174 to be "parked" in their forwardmost positions by pivoting the control shafts about their connections with the respective linkages 162, 164 so as to position each of the control shafts in the portion of the L-shaped hole that extends generally circumferentially; the rear wall of this circumferential portion then prevents the control shaft from being moved axially rearward. The linkages 162, 164 are biased by springs (not shown) in the downstream direction (to the right in FIGS. 7 and 8) so that the rings 152, 154 are biased toward the first configuration as shown in FIG. 9. The actuator device(s) must overcome the spring forces in order to move the rings to the second or third configurations.

Many modifications and other embodiments of the inventions set forth herein will come to mind to one skilled in the art to which these inventions pertain having the benefit of the teachings presented in the foregoing descriptions and the associated drawings. For example, one-ring and two-ring embodiments have been illustrated and described. However, the invention is not limited to one or two rings. If desired in a particular application, the variable-geometry ported shroud could employ three rings (enabling four different port locations), or four rings (enabling five different port locations), etc. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A compressor having a variable-geometry ported shroud, comprising:

a compressor housing defining an inlet duct, a shroud, and a bypass passage;

a compressor wheel rotatably mounted in the compressor housing; and a variable-geometry port comprising an opening extending through the shroud into the bypass passage, the variable-geometry port comprising an adjustable mechanism that is selectively configurable to adjust a meridional location of the port between at least first and second meridional locations, wherein the mechanism comprises a bypass control device disposed within the opening and axially movable therein, the bypass control device having an axial length less than that of the opening such that in all possible axial positions of the bypass control device there is a portion of the opening that remains unblocked by the bypass control device and forms the port through the shroud, the bypass control device being axially movable within the opening between at least first and second positions that respectively place the port at the first and second meridional locations.

2. The compressor of claim 1, wherein the bypass control device comprises separately formed first and second bypass control members that are axially movable together as a unit as well as independently of each other in order to adjust port location.

3. The compressor of claim 2, wherein the first and second bypass control members can be abutted against each other and positioned at one axial end of the opening in the shroud to position the port at the first meridional location, can be abutted against each other and positioned at an opposite axial end of the opening to position the port at the second meridional location, and can be axially spaced apart from each other to position the port at an intermediate third location between the first and second bypass control members.

4. A compressor with a variable-geometry ported shroud, comprising:

a compressor wheel having a hub and a plurality of blades that have radially outer tips;

a compressor housing defining a shroud proximate the tips of the blades, the shroud and the hub cooperating to define a main flow path for fluid to flow through and be compressed by the blades, the compressor housing further defining an inlet for leading fluid into the compressor;

a bypass passage defined in the compressor housing and defining an exit through which fluid in the bypass passage discharges into the fluid flowing through the inlet;

an opening axially spaced from the exit and extending through the shroud such that fluid can flow between the main flow path and the bypass passage through the opening, the opening having an axial length between an upstream edge and a downstream edge of the opening; and a bypass control device disposed in the compressor housing and axially movable relative to the opening between a first position in which the bypass control device blocks one portion of the axial length of the opening while a remaining portion of the axial length is open and defines a first port for fluid flow therethrough, and a second position in which the bypass control device blocks another portion of the axial length of the opening while a remaining portion of the axial length is open and defines a second port for fluid flow therethrough, the first and second ports being at different meridional locations along the shroud.

5. The compressor of claim 4, wherein the opening is annular and the bypass control device is annular and has an axial length less than the axial length of the opening.

6. The compressor of claim 5, wherein the bypass control device at least partially resides within the opening.

7. The compressor of claim 5, wherein the opening is the only passage by which fluid can flow from the main flow path into the bypass passage.

8. The compressor of claim 5, wherein the bypass control device comprises a first bypass control member and a second bypass control member, the first and second bypass control members abutting each other to prevent fluid flow therebetween in both the first and second positions of the bypass control device, and wherein the first and second bypass control members are configured and arranged to be axially moved away from each other to define a third position of the bypass control device in which a third port is defined between the first and second bypass control members through which fluid can flow between the main flow path and the bypass passage.

9. The compressor of claim 8, wherein the first and second bypass control members respectively comprise first and second ring portions that at least partially reside within the annular opening in the shroud.

10. The compressor of claim 9, wherein the first and second bypass control members are connected to an actuator assembly operable to effect axial movement of the first and second bypass control members independently of each other.

11. The compressor of claim 10, wherein the first and second bypass control members further comprise first and second connecting portions respectively joined to the first and second ring portions and residing at least partially within the bypass passage, and wherein the actuator assembly includes first and second linkages respectively connected to the first and second connecting portions.

12. The compressor of claim 11, wherein the first connecting portions project radially outwardly from the first ring portion and extend radially beyond the second ring portion, and the second connecting portions project radially outwardly from the second ring portion and extend radially beyond the first ring portion, the first connecting portions and associated first linkages being circumferentially staggered relative to the second connecting portions and associated second linkages.

13. The compressor of claim 12, wherein there are two first connecting portions located on diametrically opposite sides of the first ring portion, and two second connecting portions located on diametrically opposite sides of the second ring portion.

14. The compressor of claim 13, wherein the first connecting portions are staggered 90° relative to the second connecting portions.

15. The compressor of claim 13, wherein the first linkages comprise a pair of first elongate members having ends respectively connected to the first connecting portions, the first elongate members extending axially in the bypass passage, and the second linkages comprise a pair of second elongate members having ends respectively connected to the second connecting portions, the second elongate members extending axially in the bypass passage.

16. The compressor of claim 15, wherein opposite ends of the first elongate members are connected to a first mechanism operable to effect axial movement of the first elongate members to adjustably position the first bypass control member relative to the opening in the shroud, and opposite ends of the second elongate members are connected to a second mechanism operable to effect axial movement of the second elongate members to adjustably position the second bypass control member relative to the opening in the shroud.

17. The compressor of claim 16, further comprising a guide assembly defining first guide passages that receive the first elongate members and guide the axial movement thereof, and second guide passages that receive the second elongate members and guide the axial movement thereof.

18. The compressor of claim 17, wherein the guide assembly comprises an integral part of an insert that is formed separately from the compressor housing and is installed in the compressor housing, and wherein the insert forms at least part of the shroud.

19. The compressor of claim 18, wherein the bypass passage is defined between the insert and a wall of the compressor housing.

* * * * *